US008505778B2

(12) United States Patent
Welp

(10) Patent No.: US 8,505,778 B2
(45) Date of Patent: Aug. 13, 2013

(54) MANUAL PISTON PUMP HAVING A BLOCKABLE DISPENSING HEAD FOR DISPENSING FLUID SUBSTANCES

(75) Inventor: Karl Gisbert Welp, Sundem (DE)

(73) Assignee: MeadWestvaco Corporation, Richmond, VA (US)

( * ) Notice: Subject to any disclaimer, the term of this patent is extended or adjusted under 35 U.S.C. 154(b) by 992 days.

(21) Appl. No.: 11/909,306

(22) PCT Filed: Mar. 21, 2006

(86) PCT No.: PCT/EP2006/002558

§ 371 (c)(1),
(2), (4) Date: Jul. 29, 2008

(87) PCT Pub. No.: WO2006/100027

PCT Pub. Date: Sep. 28, 2006

(65) Prior Publication Data

US 2009/0039109 A1 Feb. 12, 2009

(30) Foreign Application Priority Data

Mar. 23, 2005 (DE) ..... 10 2005 013 409

(51) Int. Cl.
*B67B 1/00* (2006.01)

(52) U.S. Cl.
USPC ..... 222/153.04; 222/153.13; 222/321.9; 222/383.3; 222/384; 222/514; 222/385

(58) Field of Classification Search
USPC ..... 222/153.01–153.13, 321.9, 383.1, 222/383.3, 385, 514–515, 384
See application file for complete search history.

(56) References Cited

U.S. PATENT DOCUMENTS

| | | | | | |
|---|---|---|---|---|---|
| 5,255,823 | A | * | 10/1993 | Tichy et al. | 222/153.14 |
| 5,405,057 | A | * | 4/1995 | Moore | 222/153.14 |
| 5,524,793 | A | * | 6/1996 | O'Neill | 222/153.13 |
| 5,615,806 | A | * | 4/1997 | Grothoff | 222/153.13 |
| 5,715,973 | A | * | 2/1998 | Foster et al. | 222/153.13 |
| 6,045,008 | A | * | 4/2000 | Gonzalez Fernandez et al. | 222/153.13 |
| 6,065,647 | A | * | 5/2000 | Bliss et al. | 222/153.02 |

* cited by examiner

*Primary Examiner* — Paul R Durand
*Assistant Examiner* — Andrew P Bainbridge
(74) *Attorney, Agent, or Firm* — MeadWestvaco Intellectual Property Group

(57) ABSTRACT

Manual piston pump having a lockable dispensing head, having a cylinder, an inner locking sleeve forming a cylindrical passage for a hollow piston rod, one end of this extending into a pump chamber of the cylinder and the other end carrying the dispensing head, which is provided with an outer shaft section. A spring presses the piston rod outwards in relation to the cylinder, into a rest position, and in opposition to the spring the piston rod may be lowered by pressing on the dispensing head to dispense substance. To block the dispensing head at least one projection can be placed in engagement with a recess, and the recess has a latching lug arranged on a resilient web articulatedly mounted at the end side and can be latched as a joining partner to the projection.

15 Claims, 2 Drawing Sheets

MANUAL PISTON PUMP HAVING A BLOCKABLE DISPENSING HEAD FOR DISPENSING FLUID SUBSTANCES

CROSS-REFERENCE TO RELATED APPLICATIONS

This application claims the benefit of German Application No. 10 2005 013 409.2, entitled "Handkolbenpumpe mit blockierbarem Ausgabekopf zur Ausgabe von fluiden Substanzen," filed 23 Mar. 2005, and PCT Application No. PCT/EP2006/002558, entitled "Handkolbenpumpe mit blockierbarem Ausgabekopf zur Ausgabe von fluiden Substanzen," filed 21 Mar. 2006, and incorporates each application herein by reference in their entirety.

BACKGROUND OF THE INVENTION

1. Field of the Invention

The invention relates to a manual piston pump having a blockable dispensing head for dispensing fluid substances, having a cylinder, an inner locking sleeve forming a cylindrical passage for a hollow piston rod to pass through, one end of this extending into a pump chamber of the cylinder and the other end carrying the dispensing head, which is provided with an outer shaft section, a spring which presses the piston rod outwards in relation to the cylinder, into a rest position, and in opposition to the spring force whereof the piston rod may be lowered by pressing on the dispensing head in order to dispense substance, and having a means for blocking the dispensing head, this means including at least one projection which can be placed in engagement with a recess.

2. State of the Art

DE 33 16 308 A1 discloses a manual pump which has a dispensing head mounted on the shaft of the pump itself. In the normal rest condition, this shaft projects beyond the exterior of a hollow main part forming the base body of the pump. The lower end of a hollow movable shaft extends inside the cavity of the main part and is pressed outwards by a spring acting on its lower end. Furthermore, a locking sleeve is fixedly connected to the hollow main part. The pump has one or more cams or small teeth or projections, as a result of which the dispensing head may be locked to the locking sleeve. Moreover, the pump has one or more sealing inserts which close off in relation to the outside atmosphere when the dispensing head is locked on the base body of the pump.

The advantage of a lockable dispensing head is linked to the disadvantage that, when the dispensing head is pressed down, it is frequently skewed. When the dispensing head is skewed, the piston strokes are not performed in their entirety, with the result that these strokes are performed multiple times, which means that undesirable excessive quantities are then supplied. Furthermore, there is increased wear.

The object of the invention is therefore to provide a manual piston pump having a cylinder, an inner locking sleeve forming a cylindrical passage for a hollow piston rod to pass through, one end of this extending into a pump chamber of the cylinder and the other end carrying the dispensing head, which is provided with an outer shaft section, a spring which presses the piston rod outwards in relation to the cylinder, into a rest position, and in opposition to the spring force whereof the piston rod may be lowered by pressing on the dispensing head in order to dispense substance, and having a means for blocking the dispensing head, this means including at least one projection which can be placed in engagement with a recess, which is equipped with a locking sleeve and at the same time operates reliably and with low wear.

BRIEF DESCRIPTION OF THE DRAWINGS

The invention will be explained in more detail below with reference to the exemplary embodiment illustrated in the attached drawings.

DETAILED DESCRIPTION OF THE INVENTION

Figure 2:
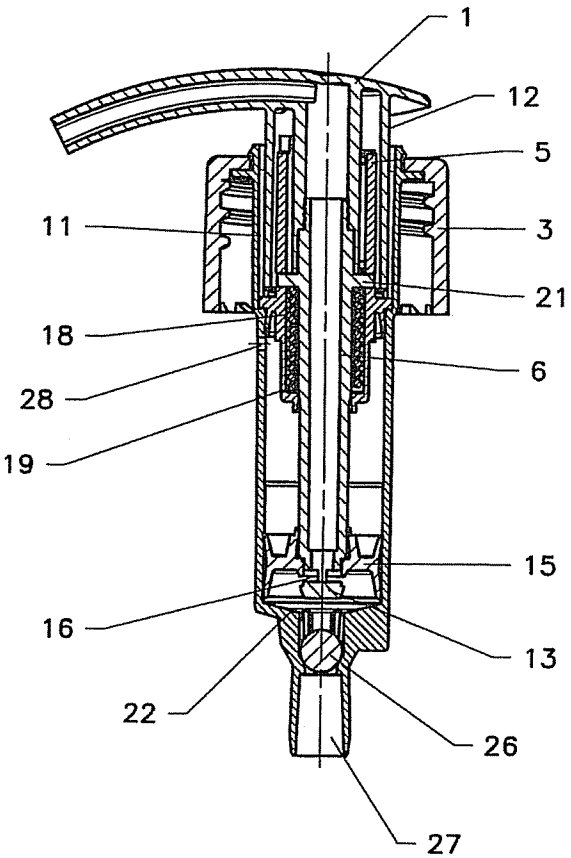
FIG. 2 shows, diagrammatically and in longitudinal section, the manual piston pump according to FIG. 1, with the dispensing head lowered.

With this, a manual piston pump is provided in which the locking sleeve encapsulates the spring in order to position the spring for the purpose of low-wear spring pre-tensioning of the dispensing head and for the purpose of controlling pre-tensioning against the locking element, and furthermore this encapsulation means forms, together with the cylinder, a track for the external shaft section of the dispensing head to move along. In this case, the dispensing head is not only reliably locked but the dispensing head is also guided during piston strokes, as a result of which pressure on the dispensing head at an oblique angle is compensated. It is not possible for skewing to occur. The pre-tension acting on the locking element furthermore compensates for manufacturing tolerances, without having any adverse effect on functionality. The possibility that the fluid substance will oxidize is eliminated because the spring is arranged outside the product flow.

Preferably, the use of two projections as the locking element, which act as pins to provide a support for the spring without this having an adverse effect on its function of being capable of engaging in a recess in order to bring about locking.

The dispensing head may be locked in the top position and/or in the bottom position.

Further embodiments of the invention are apparent from the description below and from the claims.

The invention relates to a manual piston pump having a blockable dispensing head 1 for dispensing fluid substances. The manual piston pump includes a cylinder 2 whereof the upper end is fixedly connected to a closure 3, which may be secured to the mouthpiece of a container (not illustrated) for receiving a liquid or soap-type substance to be dispensed. The closure 3 is in this case provided with a thread acting as the closing element. The cylinder 2 may have a ring 4 acting as the upper termination.

An inner locking sleeve 5 is seated in a fixedly positioned manner in the cylinder 2 in such a way that a cylindrical passage is formed for a hollow piston rod 6 to pass through. The locking sleeve 5 is preferably clamped in the cylinder 2, and for this purpose the locking sleeve 5 may carry a clamping ring 7 which has a sealing lip 8 and may be supported against a shoulder 9 of the cylinder 2. The locking sleeve 5 extends along the length of an upper portion of the cylinder 2, with an upper end 10 of the locking sleeve 5 extending as far as an upper end of the cylinder 2, in this case formed by the ring 4, or being capable of projecting beyond the ring 4.

Together with the cylinder 2 and along the length of an upper section of the cylinder 2 facing the dispensing head 1, the locking sleeve 5 forms a guide channel 11 acting as a track for an outer shaft section 12 of the dispensing head 1 to move along, parallel to the piston rod 6. In addition to the outer shaft section 12, the dispensing head 1 has an inner shaft section which is spaced therefrom, by way of which it is secured to the piston rod 6 and which prolongs the dispensing channel 29 beyond the hollow piston rod 6.

By means of one end 13 the piston rod 6 extends into a pump chamber 22 of the cylinder 2, and at the other end 14 it carries the dispensing head 1 provided with the outer shaft section 12. At the one end 13 there is seated a collar 15 which seals the pump chamber 22 of the cylinder 2 off from the upper part of the cylinder 2. The end 13 has at least one inlet opening 16 for connecting the pump chamber 22 to a cavity 17 inside the hollow piston rod 6.

Together with the piston rod 6, the locking sleeve 5 forms an inner cage 18 for receiving a spring 19 which presses the piston rod 6 outwards in relation to the cylinder 2, into a rest position, and in opposition to the spring force whereof the piston rod 6 may be lowered by pressing on the dispensing head 1 in order to dispense substance. The spring 19 is supported at one end against a base 20 of the locking sleeve 5 and at the other against a locking element 21 provided on the piston rod 6.

The locking element 21 is part of a means for blocking the dispensing head 1, this means including at least one locking element which may be brought into engagement with the locking sleeve 5. The locking sleeve 5 is illustrated again as an individual part in FIG. 3. So that the manual piston pump may be locked with the dispensing head 1 in the top position and/or the bottom position, the locking sleeve 5 may be formed with appropriate recesses 23, 24 in which the locking element 21 of the piston rod 6 can engage. For this purpose, the piston rod 6 preferably has as the locking element 21 two opposing cams or projections which may be brought into engagement with the recesses 23, 24 by turning the piston rod 6 in the locking sleeve 5, by turning the dispensing head 1. In a disengaged position, the locking element 21, which extends transversely in relation to the longitudinal extent of the locking sleeve 5, is guided in grooves 25 which are formed in the locking sleeve 5 and allow longitudinal movement during piston strokes.

Figure 3:
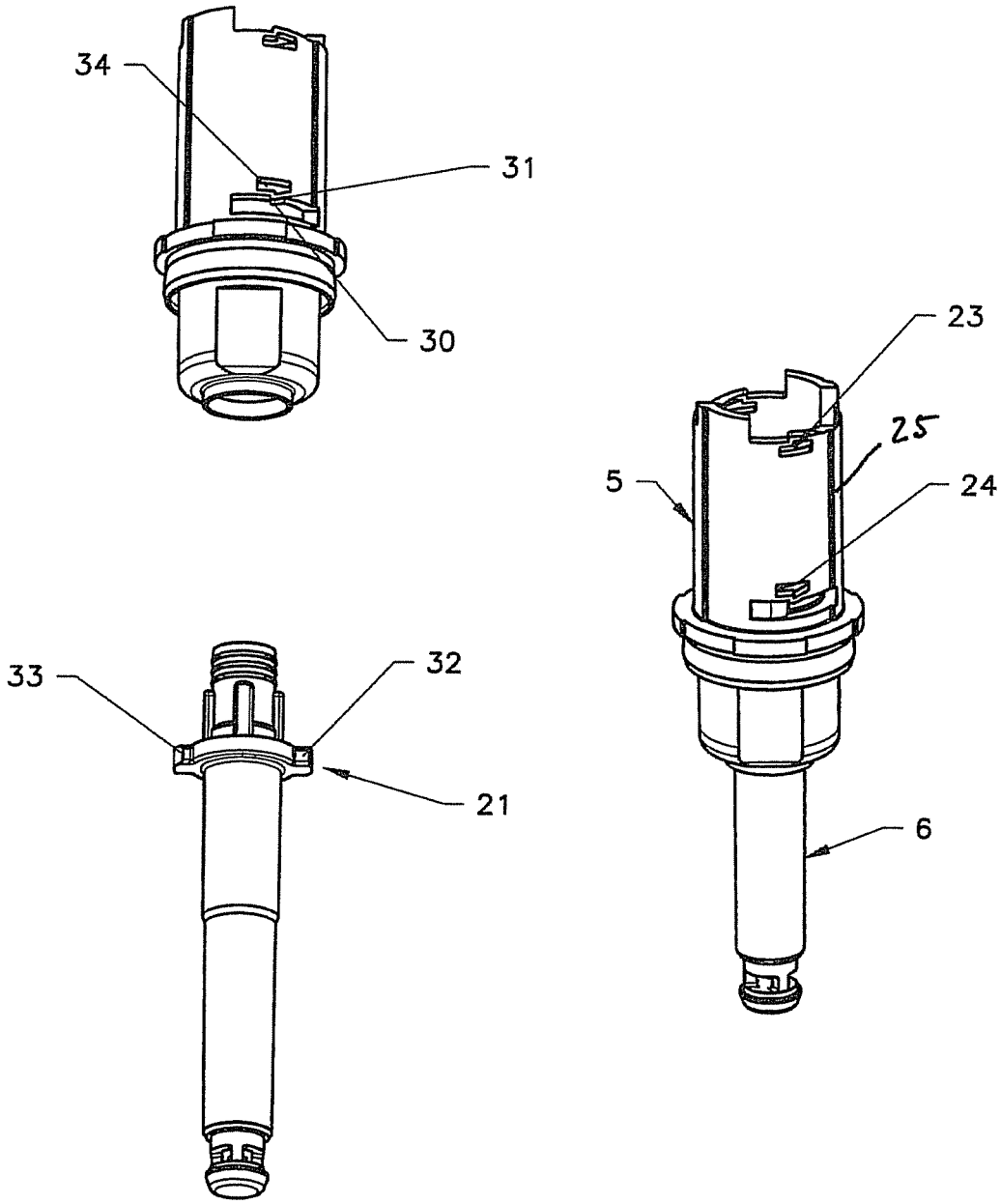
FIG. 3 shows diagrammatically a perspective side view of the locking sleeve of the manual piston pump according to FIGS. 1 and 2.

In FIG. 3, each recess 23, 24 has a latching lug 30 which is arranged on a resilient web 31 which is articulatedly mounted at the end side and can be latched as a joining partner to a projection 32, 33. For the resilient design of the web 31, the latter is preferably free-standing by means of an undercut 34. The web 31 can additionally be composed of a flexible material. If the recesses 23, 24 is or are formed, as is the case here, on a locking sleeve 5, two oppositely-arranged projections 32, 33 are preferably provided, to which are assigned opposite recesses 23, 24 which are offset by preferably 180°. The position of the recesses 23, 24 in the longitudinal direction permits locking in the top position and/or in the bottom position.

The locking device described above is not restricted to a manual piston pump described in the exemplary embodiment. Modified manual piston pumps having projections on the dispensing head and/or a spring in the pump space can be provided with the described recesses in the same way, into which recesses projections latch in the described way.

The pump chamber 22 may preferably be closed off temporarily from a riser tube 27 by a ball 26.

Figure 1:
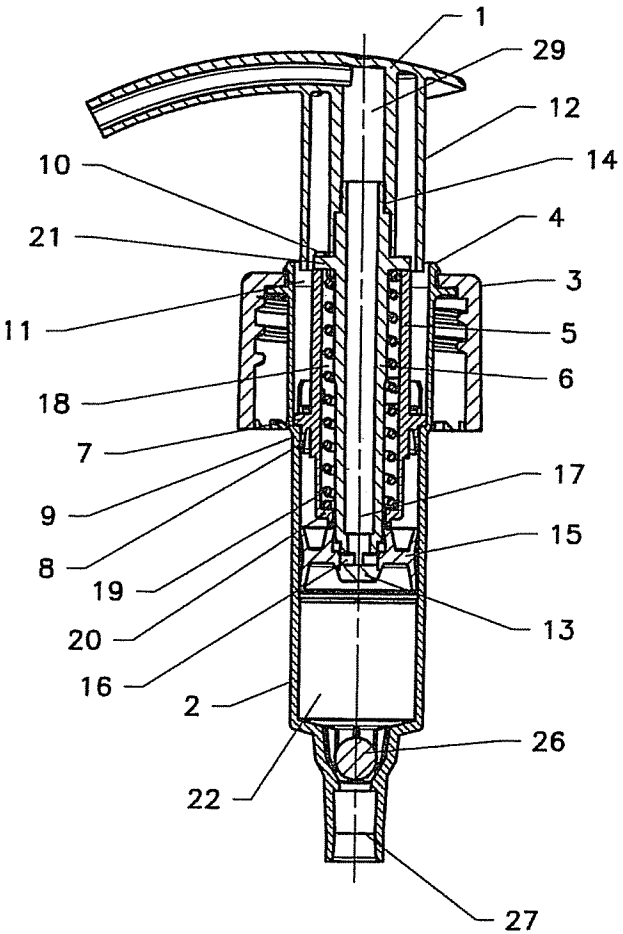
FIG. 1 shows, diagrammatically and in longitudinal section, a manual piston pump in the rest condition.

FIG. 1 illustrates the manual piston pump in the rest position. The dispensing head 1 may be locked in this top position. In the rest position, the outer shaft section 12 is preferably inserted into the guide channel 11 in order to ensure adequate guidance at the very start of each piston stroke. The clamping ring 7 of the locking sleeve 5 may form an abutment for a depth to which the outer shaft section 12 may penetrate into the guide channel 11.

FIG. 2 illustrates the manual piston pump in the lowered position. The dispensing head 1 may also be locked in this bottom position. Air may be drawn in by way of a draw-in opening 28 in the wall of the cylinder 2. Seals and/or filters for the incoming air may be provided.

The invention claimed is:

1. A manual piston pump having a dispensing head for dispensing fluid substances, comprising:

a cylinder, an inner locking sleeve forming a cylindrical passage for a hollow piston rod to pass through, one end of the piston rod extending into a pump chamber of the cylinder and the other end carrying the dispensing head, which is provided with an outer shaft section, a spring which presses the piston rod outwards in relation to the cylinder, into a rest position, and in opposition to the spring force whereof the piston rod may be lowered by pressing on the dispensing head in order to dispense substance, at least one projection and at least one recess, wherein the at least one recess comprises a latching lug arranged on a resilient web which is articulately mounted at the end side and can be latched as a joining partner to the at least one projection, and, wherein the inner locking sleeve together with the cylinder form a guide channel between the inner locking sleeve and the cylinder, the guide channel acting as a track for the outer shaft section of the dispensing head to move along, parallel to the piston rod, and wherein the piston rod and the inner locking sleeve form an inner cage for receiving the spring.

2. The manual piston pump of claim 1, wherein the at least one recess is formed on the inner locking sleeve.

3. The manual piston pump of claim 1, wherein the resilient web comprises a flexible material.

4. The manual piston pump of claim 1, wherein the at least one recess further comprises a first recess for locking the dispensing head in a top position and a second recess for locking the dispensing head in a bottom position.

5. The manual piston pump of claim 1, wherein the spring is supported at one end against a base of the inner locking sleeve and at the other against a locking element on the piston rod.

6. The manual piston pump of claim 5, wherein the locking element comprises two opposing projections extending transversely in relation to the longitudinal extent of the inner locking sleeve.

7. A manual pump, comprising:

a cylinder defining a pump chamber;

an inner locking sleeve extending into at least a portion of the pump chamber of the cylinder, the inner locking sleeve defining an interior space;

at least one groove in the inner locking sleeve and open to the interior space;

a piston rod extending into at least a portion of the interior space of the inner locking sleeve, wherein the piston rod further comprises at least one locking element configured to move in the groove a spring positioned in an interior space between the piston rod and the inner locking sleeve;

a dispensing head carried on the piston rod, the dispensing head provided with an outer shaft section;

at least one recess in the inner locking sleeve configured to engage with the locking element of the piston rod to prevent movement of the piston rod relative to the inner locking sleeve, and, a guide channel between the inner locking sleeve and the cylinder, the guide channel acting as a track for the outer shaft section of the dispensing head to move along, parallel to the piston rod.

8. The manual pump of claim 7, wherein the spring resists movement of the piston rod in the inner locking sleeve.

9. The manual pump of claim 7, wherein the at least one recess in the inner locking sleeve comprises at least one latching lug.

10. The manual pump of claim 7, wherein the at least one recess in the inner locking sleeve comprises a resilient web.

11. The manual pump of claim 7, wherein rotation of the dispensing head rotates the at least one locking element of the piston rod.

12. The manual pump of claim 7, wherein the at least one locking element of the piston rod further comprises a first projection and a second opposing projection.

13. The manual pump of claim 12, wherein the first projection is configured to engage a first recess in the inner locking sleeve and the second opposing projection is configured to engage a second recess in the inner locking sleeve.

14. The manual pump of claim 7, wherein the at least one recess comprises at least one recess configured to mate with the at least one locking element to hold the piston in a top position.

15. The manual pump of claim 7, wherein the at least one recess comprises at least one recess configured to mate with the at least one locking element to hold the piston in a bottom position.

* * * * *